United States Patent [19]

Morabit

[11] Patent Number: 4,558,518

[45] Date of Patent: Dec. 17, 1985

[54] TIP STABILIZING DEVICE FOR A CHAIN SAW

[76] Inventor: Vincent D. Morabit, 1230 Wendy Rd., Rock Hill, S.C. 29730

[21] Appl. No.: 454,641

[22] Filed: Dec. 30, 1982

[51] Int. Cl.[4] ..... B27B 17/02

[52] U.S. Cl. ..... 30/371; 30/372; 30/382; 83/743; 83/745

[58] Field of Search ..... 83/745, 743; 30/371, 30/383, 382, 381, 372, 373, 385, 386

[56] References Cited

U.S. PATENT DOCUMENTS

| | | | |
|---|---|---|---|
| Re. 24,129 | 3/1956 | Hassler . | |
| Re. 24,588 | 1/1959 | Budd | 30/371 |
| 1,016,664 | 2/1912 | Bailey . | |
| 1,201,467 | 10/1916 | Hoglund | 128/317 |
| 1,319,712 | 10/1919 | Kendon | 30/383 |
| 1,903,571 | 4/1933 | Meyer . | |
| 2,038,626 | 4/1936 | Arsneau . | |
| 2,165,524 | 7/1939 | Wolf . | |
| 2,256,786 | 9/1941 | Fritz . | |
| 2,432,567 | 12/1947 | Forrest | 30/339 |
| 2,444,132 | 6/1948 | Gordon et al. . | |
| 2,525,110 | 10/1950 | Adair | 30/371 |
| 2,665,719 | 1/1954 | Pennanen | 30/371 |
| 2,698,035 | 12/1954 | Smith . | |
| 2,755,826 | 7/1956 | Kiekhaefer . | |
| 2,779,359 | 1/1957 | Koski . | |
| 2,813,556 | 11/1957 | Woodworth | 30/371 |
| 2,821,213 | 1/1958 | York | 30/371 |
| 2,910,099 | 10/1959 | Mall . | |
| 2,925,105 | 2/1960 | Hayden . | |
| 3,098,511 | 7/1963 | Consoletti | 30/382 |
| 3,158,956 | 12/1964 | Gudmundsen | 30/371 |
| 3,680,607 | 8/1972 | Robinson . | |
| 3,713,466 | 1/1973 | Lund | 83/790 |
| 3,808,684 | 5/1974 | Ludwig | 30/382 |
| 3,815,229 | 6/1974 | Granberg | 30/382 |
| 3,995,370 | 12/1976 | Allard et al. | 30/382 |
| 4,142,292 | 3/1979 | Ulrich | 30/371 |
| 4,193,193 | 3/1980 | Holzworth | 30/382 |
| 4,297,786 | 11/1981 | Tuggle | 30/382 |
| 4,317,285 | 3/1982 | Graham | 30/371 |

FOREIGN PATENT DOCUMENTS

| | | |
|---|---|---|
| 217880 | 1/1957 | Australia . |
| 506987 | 11/1954 | Canada . |
| 690453 | 4/1940 | Fed. Rep. of Germany . |

OTHER PUBLICATIONS

*Chain Saw Age,* "Firewood Accessory Available", p. 44, Nov. 1976.

Homelite Safe-T-Tip Instruction Booklet.

*Primary Examiner*—Jimmy C. Peters

*Attorney, Agent, or Firm*—Banner, Birch, McKie & Beckett

[57] ABSTRACT

A tip stabilizing device for attachment to a portable power chain saw or the like for improving its operation and safety. When attached to the forward end of the chain saw guide bar, a plurality of spikes extend forward, backward or outward to the sides of the guide bar to engage an adjacent log or other supporting surface or the object being cut by the saw to stabilize the saw tip. The forces generated at the chain/wood interface are utilized to keep the tip stabilizing device in operative engagement with such surface.

26 Claims, 29 Drawing Figures

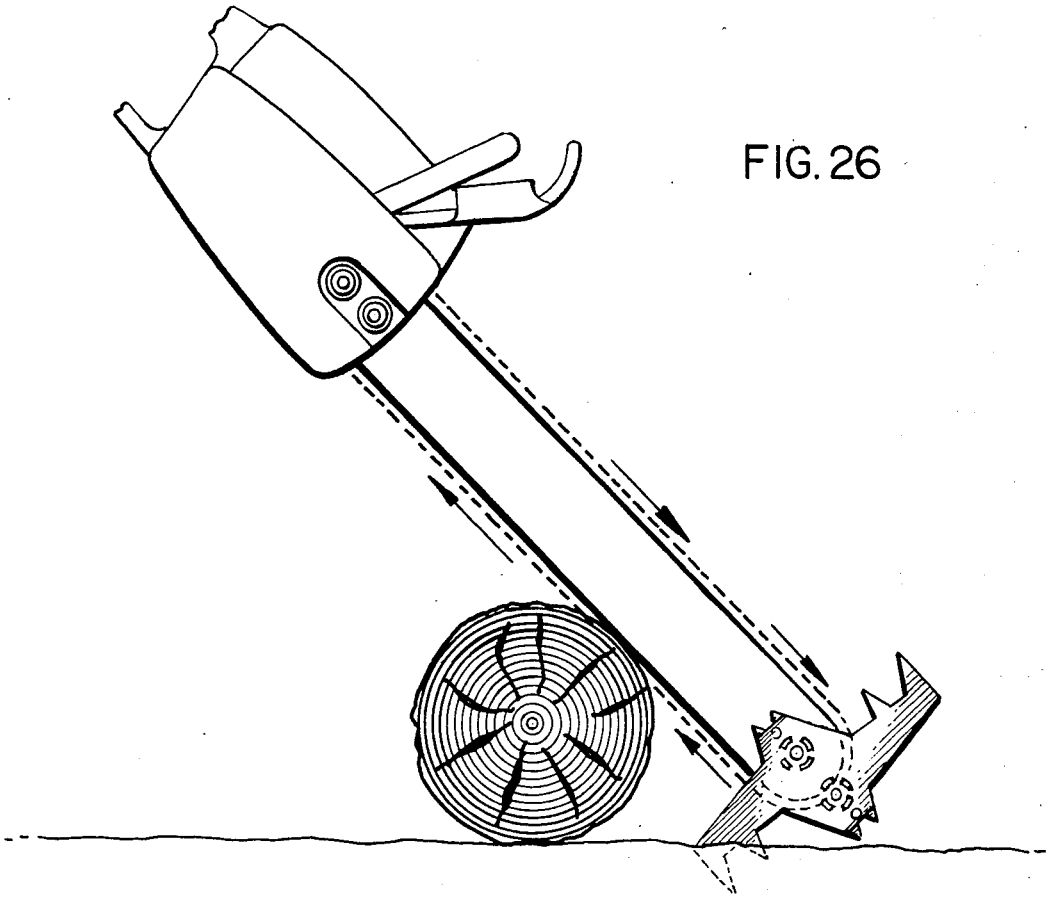
FIG. 26
FIG. 27
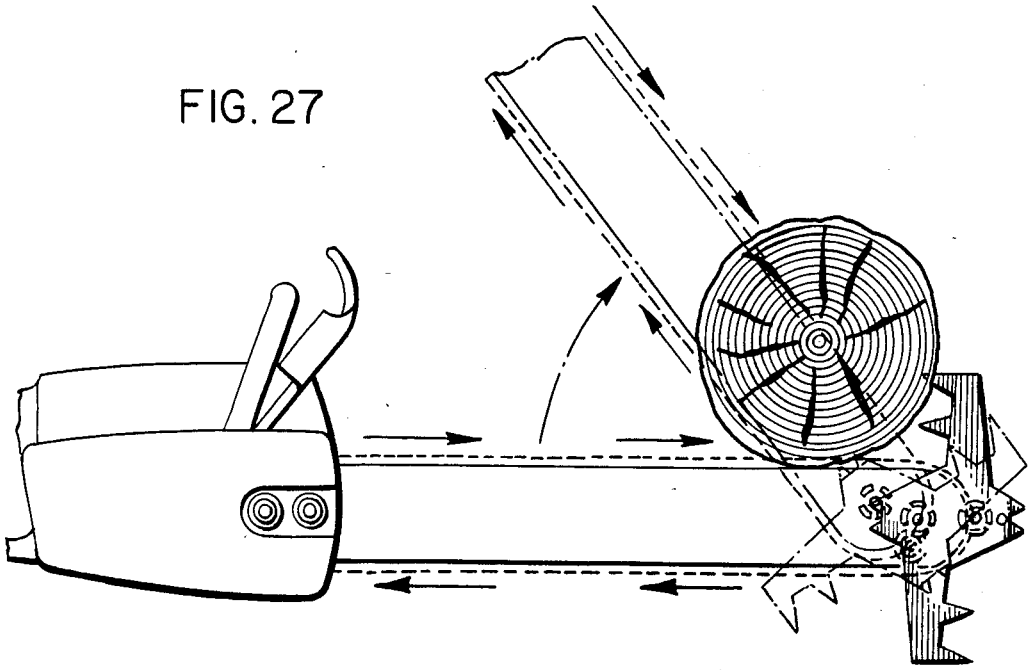

FIG. 28
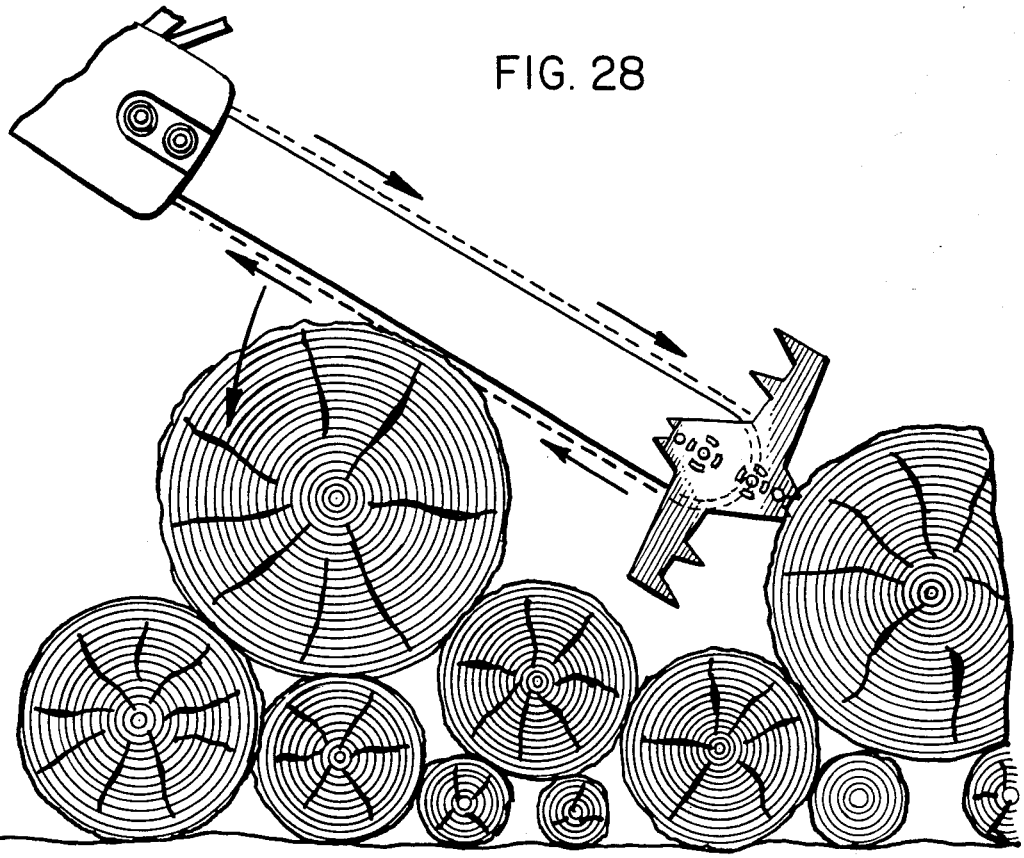
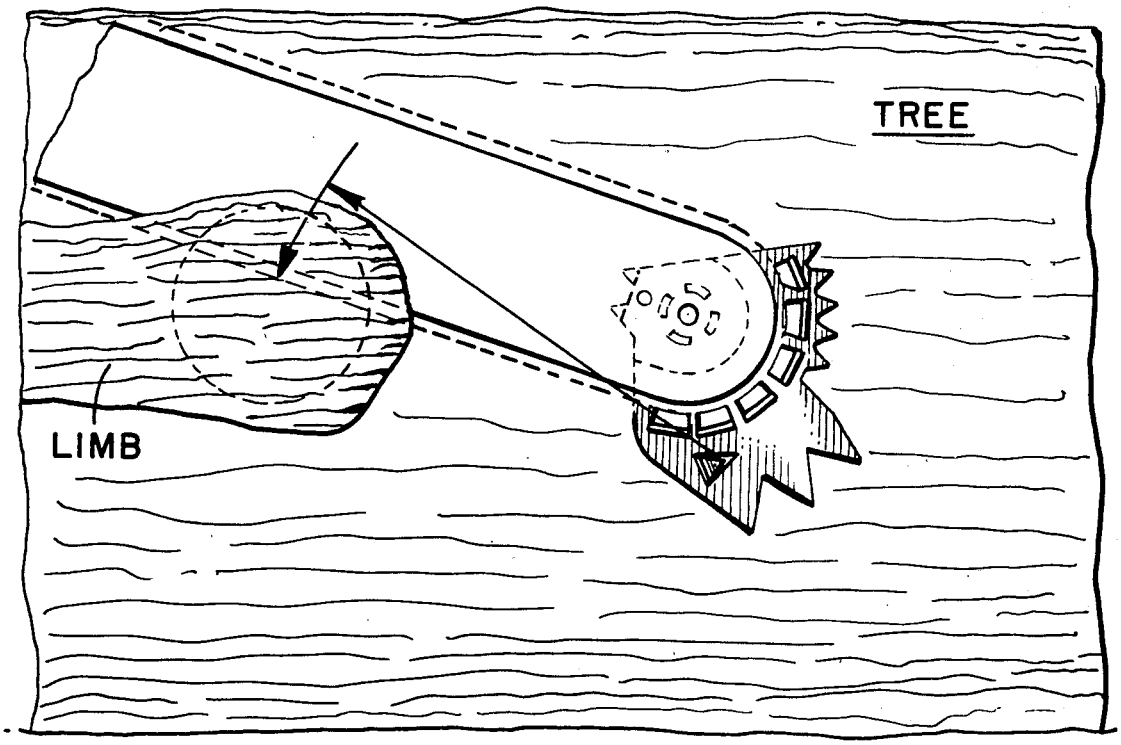
FIG. 29

TIP STABILIZING DEVICE FOR A CHAIN SAW

BACKGROUND OF THE INVENTION

This invention relates generally to the field of saws and, more particularly, to a device for attachment to a portable power chain saw or the like for improving its operation and safety.

It is well known that portable power chain saws create a substantial risk of injury to the user, especially if improperly or carelessly used. The hazards relate primarily to the exposed nature of the chain moving along the guide bar. The fact that chain saws are basically hand tools whose control is often left to the strength and skill of the operator makes them especially dangerous. This is particularly so when it is considered that the very purpose of chain saws often relegate their use to less than ideal environments, such as wooded areas where dense and damp underbrush with rugged terrain and other inclement conditions often prevent the operator from obtaining the necessary leverage to exert sufficient control over the saw.

One of the most dangerous aspects of chain saw operation involves what is known as "kickback". Kickback may be a rapid movement of the saw which can occur as a result of careless operation of the saw. Kickback is an inherent phenomenon in chain saws which may occur when contact with another object is made by the moving chain as the chain moves around the nose of the guide bar. When kickback occurs, the saw may violently kick back from the object being cut and possibly result in severe injury to the operator.

Another potential danger associated with chain saws is the vibration emitted therefrom during operation. It has been reported that vibration from hand-held tools such as chain saws can contribute to a condition known as Raynaud's Syndrone. Symptons may include tingling, numbness and blanching of the fingers.

There have been many attempts in the prior art to improve the safety of chain saws, including some intended to prevent the conditions for kickback from occurring or minimizing the effects of kickback. These attempts sometimes involved the addition of various guards and automatic braking mechanisms to the saw. For example, U.S. Pat. No. 4,193,193 to Holzworth discloses a guard which extends from the motor housing along the top of the guide bar above the chain and down over the nose of the saw. While the guard may prevent inadvertent contact with the moving chain along the top of the guide bar, such a guard, however, precludes use of the vitally needed upper cutting surface of the saw.

Braking devices also have limitations in that they do not prevent kickback from occurring and do not significantly halt the motion of the chain after kickback has occurred. Thus, the operator may still be violently struck and seriously injured with the sharp chain even if the brake timely engages. Brakes are also relatively expensive and may cause damage to the saw. Further, it is difficult and impractical for the effectiveness of breaking devices to be measured by an operator who is relying on such a device to prevent injury in the event of kickback.

Other efforts to provide a safer chain saw have included various designs of the saw chain and guide bar. These measures also have significant practical drawbacks in that the result is that the saw is often less efficient and less capable of performing the tasks for which it is needed. Such designs of the saw chain, for example, are diminished by use of the saw or defeated by filing of the chain.

Although safety devices customarily add weight and expense and often result in some loss of utility, the ideal safety device for a chain saw should have the following characteristics. The device should:

1. make the saw safer to operate;
2. not result in significant loss of utility;
3. not significantly increase the weight of the saw;
4. not significantly increase the expense of the saw;
5. add new utility to offset any added weight, expense or loss of old utility (thereby discouraging removal);
6. make the saw easier to operate with less operator fatigue; and
7. not be diminished by use or defeated by operator action.

While the chain saw safety devices known in the prior art meet some of the above characteristics, they remain deficient in most areas.

Even with the various safety devices of the prior art, chain saws are still extremely dangerous to operate due to the problems associated with the operator not having full control over the saw at all times. The difficulty in maintaining control is primarily related to the unsecured tip of the saw. While the operator may be able to maintain fairly good control over the motor end of the saw, where the handles are located, complete control is not possible without means for directly controlling the saw tip. This is especially important in situations where the danger of kickback is present. Therefore, in order to efficiently maximize control over a chain saw, means must be provided to stabilize the saw tip with the objective being to satisfy the aforementioned characteristics that the ideal safety device should have.

SUMMARY OF THE INVENTION

It is the overall objective of this invention to provide a tip stabilizing device for attachment to a portable power chain saw which improves the safety, utility and operation of the saw.

A specific object of this invention is to provide a tip stabilizing device for attachment to a chain saw which prevents the conditions for kickback from occurring.

Another specific object of this invention is to provide a tip stabilizing device for attachment to a chain saw wich makes the saw more stable and easier to control without a significant loss of utility of the saw.

A further specific object of this invention is to provide a tip stabilizing device for attachment to a chain saw which is lightweight, inexpensive and readily attachable and removable from the saw.

A still further specific object of this invention is to provide a tip stabilizing device for attachment to a chain saw which substantially reduces harmful vibrations that may be transmitted from the saw to the operator.

Another specific object of this invention is to provide a tip stabilizing device for attachment to a chain saw which protects the chain and guide bar from damage due to contact with foreign objects at the nose of the guide bar.

Another specific object of this invention is to provide a tip stabilizing device for attachment to a chain saw which results in less operator fatigue.

A further specific object of this invention is to provide a tip stabilizing device for attachment to a chain saw which results in longer life of the cutting chain.

A still further specific object of this invention is to provide a tip stabilizing device for attachment to a chain saw which results in greater productivity of the operator.

Another specific object of the invention is to provide a tip stabilizing device for attachment to a chain saw which utilizes the chain and wood interactive forces to improve the operation of the device.

A further specific object of this invention is to provide a tip stabilizing device for attachment to a chain saw which can lead to improvements in the design of the guide bar, chain and chain saw (e.g., such as the addition of supporting handles and/or controls in various configurations to further improve utility, safety and operation when the saw tip is stabilized).

The tip stabilizing device of this invention is comprised of a plate having a hub or mounting feature and a plurality of spikes. The hub is used for readily mounting the device near the end of the chain saw guide bar. In one embodiment of the invention, the spikes extend forward of the guide bar and may be used to anchor the saw tip to the ground, an adjacent log or other supporting surface. In other embodiments, the spikes are reversed in order to engage the object being cut to stabilize the saw tip. In all embodiments, spikes may be added which extend outwardly from the plane of the guide bar in various directions to also provide tip stability. Certain embodiments of the invention could encompass any combination of these spikes.

A novel aspect of this invention is that the reactive forces of the wood being cut by the moving chain are used as an aid in lodging the spikes into the supporting surface. For example, when cutting on the lower guide bar section with conventional chain movement and with the spikes extending forward of the guide bar, the reactive forces tend to pull the saw forward, thus causing the spikes to further engage the supporting surface. Similarly, when cutting on the upper guide bar section with the spikes reversed, the saw is pushed in the direction of the operator, thereby resulting in the spikes further engaging the object being cut. By adjusting the direction of the spikes, depending upon which cutting surface is used and the direction of chain movement, the chain saw tip can be secured in virtually every cutting situation.

The tip stabilizing device allows a complete change of force application to the operation of the saw. In a cutting process using a stabilized tip, the wood acts as a fulcrum. However, without the stabilized tip, the chain saw requires the use of two hands so as to establish a fulcrum at either hand. The operator of a saw which is stabilized at the tip is thereby provided with a mechanical advantage.

Consequently, with the tip of the saw stabilized, there are resulting benefits to the operator: there is no need to activate the fulcrum at the rear handle end of the saw, thus permitting one-handed operation; the working effort on the operator is substantially reduced, not only from the decreased pressure required because of the mechanical advantage gained, but also from the more natural posture of the operator as the stabilized tip allows the motor end of the saw to be raised upward to within reaching position of the operator; and the tip stabilizer allows the weight of the saw to be relieved from the operator as it rests on the stabilizer. All of these benefits substantially reduce the normally heavy and fatiguing effort required of the operator.

An additional benefit resulting from the increased leverage is that a dull chain may be used to cut when it would not otherwise be effective due to the limited operator force application of a saw without a stabilized tip. This offers the advantage of not having to sharpen the saw chain as frequently, resulting in greater productivity and reduced chain replacement cost.

In addition to providing a significant increase in the stability of the saw with the resultant safety and operational benefits, the device serves a variety of other functions, including: a chain gauge for making certain checks and measurements with respect to the chain; a chain catcher to prevent whipping of the chain back toward the operator should the chain break; and, prevention of the chain from external contact at the critical nose of the guide bar, thus preventing the conditions for kickback from occurring. Another major advantage of tip stability is that vibrations which are normally transmitted from the saw to the operator, possibly resulting in detrimental physical effects, are substantially reduced.

In summary, the hazardous tip of the chain saw is converted by the stabilizer device into a major benefit and positive feature of the saw to improve its operation, safety and utility.

BRIEF DESCRIPTION OF THE DRAWINGS

FIG. 26 is a side elevational view illustrating the tip stabilizing device of FIG. 15 attached to a chain saw having conventional chain movement and engaging the ground while making a bucking cut.

FIG. 27 is a side elevational view illustrating the tip stabilizing device of FIG. 15 attached to a chain saw having conventional chain movement and engaging the log being cut while making an undercut or perhaps a felling cut.

FIG. 28 is a side elevational view illustrating the tip stabilizing device of FIG. 15 attached to a chain saw having conventional chain movement and engaging an adjacent log while making a bucking cut.

FIG. 29 is a side elevational view illustrating the tip stabilizing device of FIG. 1 attached to a chain saw having conventional chain movement and engaging a tree trunk with the side spike while performing a limbing operation.

DETAILED DESCRIPTION OF THE PREFERRED EMBODIMENTS

Figure 5:
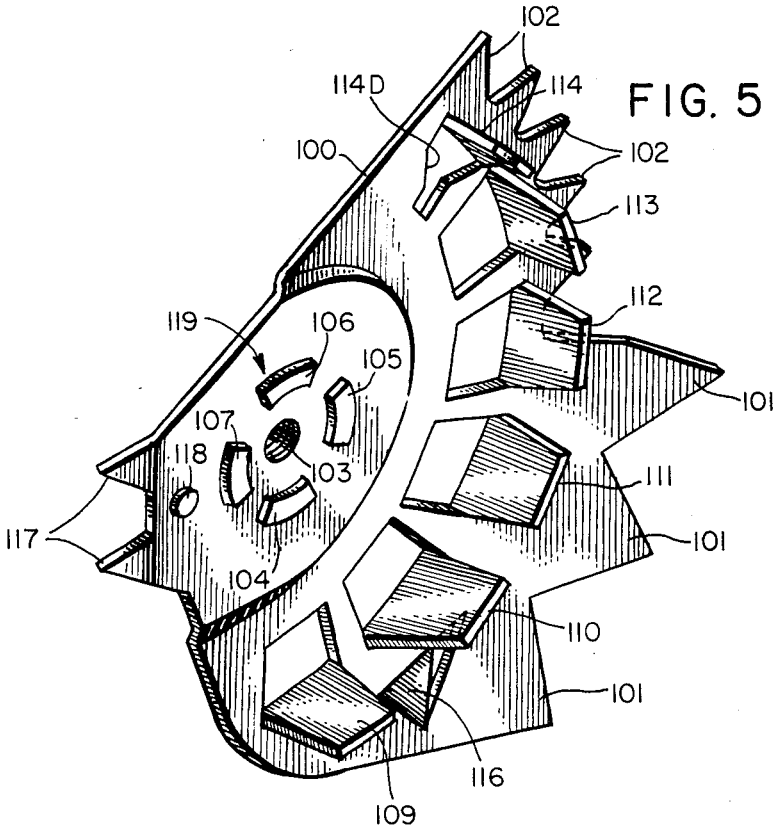
FIG. 5 is a perspective view of the base plate of the tip stabilizing device of FIG. 1.
Figure 6:
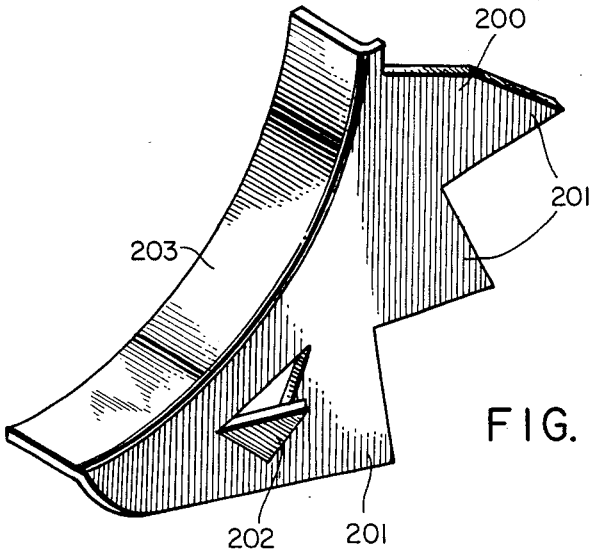
FIG. 6 is a perspective view of the secondary plate of the tip stabilizing device of FIG. 1.

In the embodiment of the present invention shown in FIGS. 1–6, the tip stabilizing device includes base plate 100 as shown in FIG. 5 and secondary plate 200 as shown in FIG. 6. Plates 100 and 200 are bonded together into a single unit as shown in FIGS. 1–4 and is attached to the forward end of the guide bar of the chain saw as described in further detail.

With reference to FIG. 5, base plate 100 includes mounting feature 119 for readily attaching and removing the tip stabilizer to the forward end of the chain saw guide bar. As shown, mounting feature 119 is comprised of mounting hole 103 for receiving a retaining bolt through a corresponding hole in the guide bar. Mounting hole 103 may be internally threaded to engage the retaining bolt or the retaininG bolt can be secured by an appropriate locking washer and nut. Mounting feature 119 also includes raised anti-rotation tab or fastener 118 and protrusions 104–107. Tab 118 is designed to engage an appropriately located hole in the guide bar, thus preventing inadvertent rotation of the tip stabilizer around mounting hole 103. Protrusions 104–107 are designed to contact appropriately located rivet heads in the guide bar, thus aiding tab 118 in preventing the tip stabilizer from inadvertently rotating. Protrusions 104–107 may also be used to apply pressure through the guide bar plates against the guide bar sprocket inner race so as to prevent sprocket wheel binding. Mounting feature 119 serves here only to illustrate one means of attaching the tip stabilizer to the guide bar. Any attachment means may be employed which securely attaches the stabilizer to the guide bar and does not interfere with the cutting operation.

Figure 1:
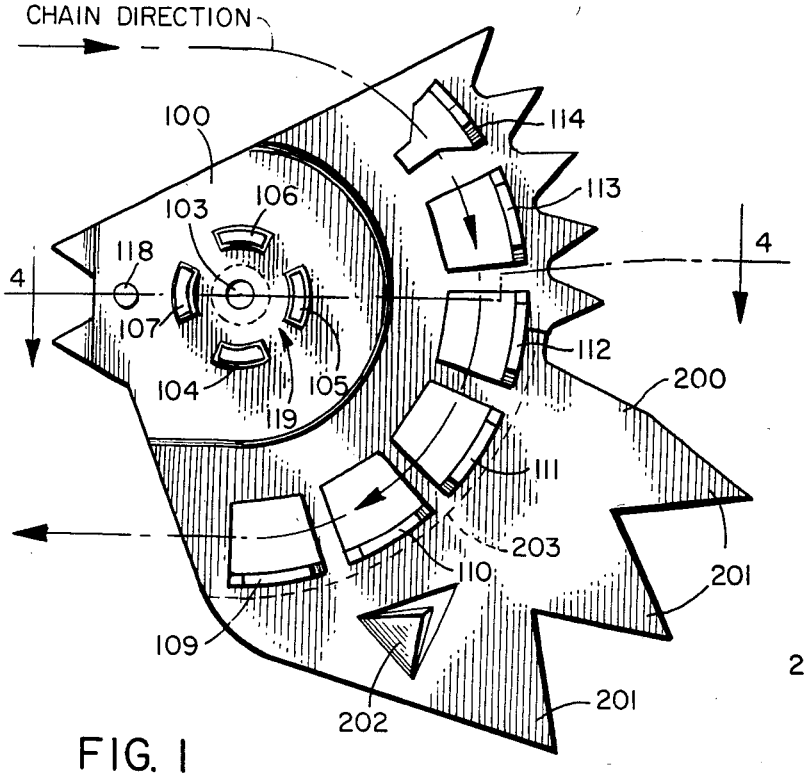
FIG. 1 is a side elevational view of the tip stabilizing device according to one embodiment of the invention.
Figure 2:
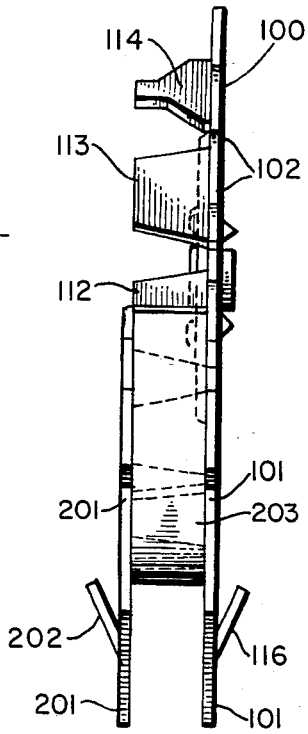
FIG. 2 is a front elevational view of the tip stabilizing device of FIG. 1.
Figure 3:
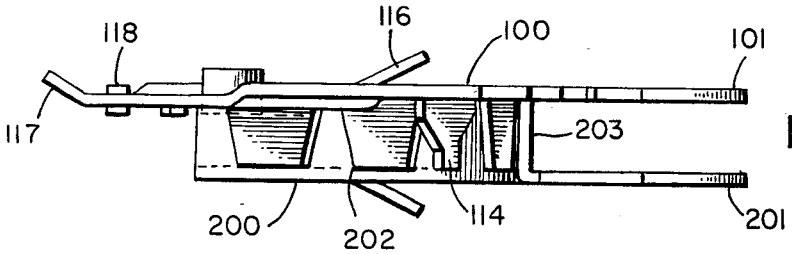
FIG. 3 is a top elevational view of the tip stabilizing device of FIG. 1.
Figure 4:
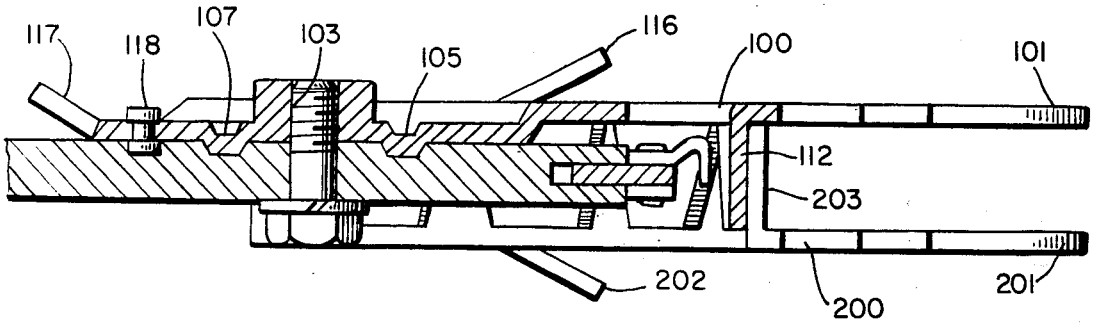
FIG. 4 is a sectional view of the tip stabilizing device of FIG. 1 along line 4—4.
Figure 14:
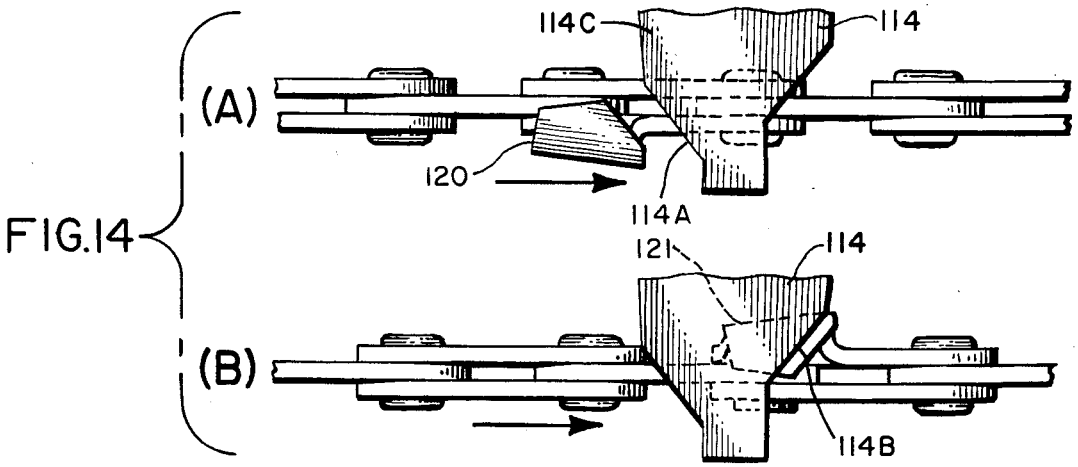
FIG. 14 is front elevational view showing the operation of the chain gauge of the various embodiments of the invention.

Base plate 100 also includes raised tabs 109–114. As shown in FIG. 5, tabs 109–114 may be blanked from plate 100 and formed perpendicular thereto. Tabs 109–114 form a guard around the saw chain which prevents the chain from flying away from the saw should the chain break. Together with flange 203, discussed below, tabs 109–114 also provide a protective shield to prevent soil, abrasions or other foreign objects from contacting the moving chain and causing damage to the chain and guide bar. As best illustrated in FIGS. 1–3, tabs 109–112 further serve as a mounting means for secondary plate 200. With reference to FIG. 14A and B, the outline of tab 114 is specially formed to provide edge 114A for measuring the top plate angle of the right hand chain cutter 120 and edge 114B for measuring the top plate angle of the left hand chain cutter 121, both without removing either the chain or the stabilizer tip from the saw. Tab 114 also includes edge 114C whose corresponding inside edge 114D on base plate 100 (see FIG. 5) may be used to measure the gullet angles of the chain.

Base plate 100 further includes elongated spikes 101, shorter spikes 102, reverse spikes 117 and outwardly projecting side spike 116. Side spike 116, like tabs 109–114, may be blanked from plate 100 at an appropriate angle. The operation of spikes 101, 102, 117 and 116 will be explained in greater detail with reference to FIGS. 17–19 and 29 below.

With reference to FIG. 6, secondary plate 200 is comprised of elongated spikes 201, outwardly projecting side spike 202 and flange 203. Flange 203 extends the full length of the rear edge of plate 200 and is used for mounting plate 200 to plate 100. Side spike 202 may likewise be blanked from secondary plate 200 at an appropriate angle. Spikes 201 and 202 correspond to spikes 101 and 116, respectively, located on base plate 100.

Base plate 100 and secondary plate 200 are formed into a single unit by bonding flange 203 to tabs 109–112 as shown in FIGS. 1–4. Bonding may be by any appropriate means, including epoxy, welding or spot welding. The application of this embodiment of the invention to a chain saw will now be discussed with reference to FIGS. 17–19 and 29.

Figure 17:
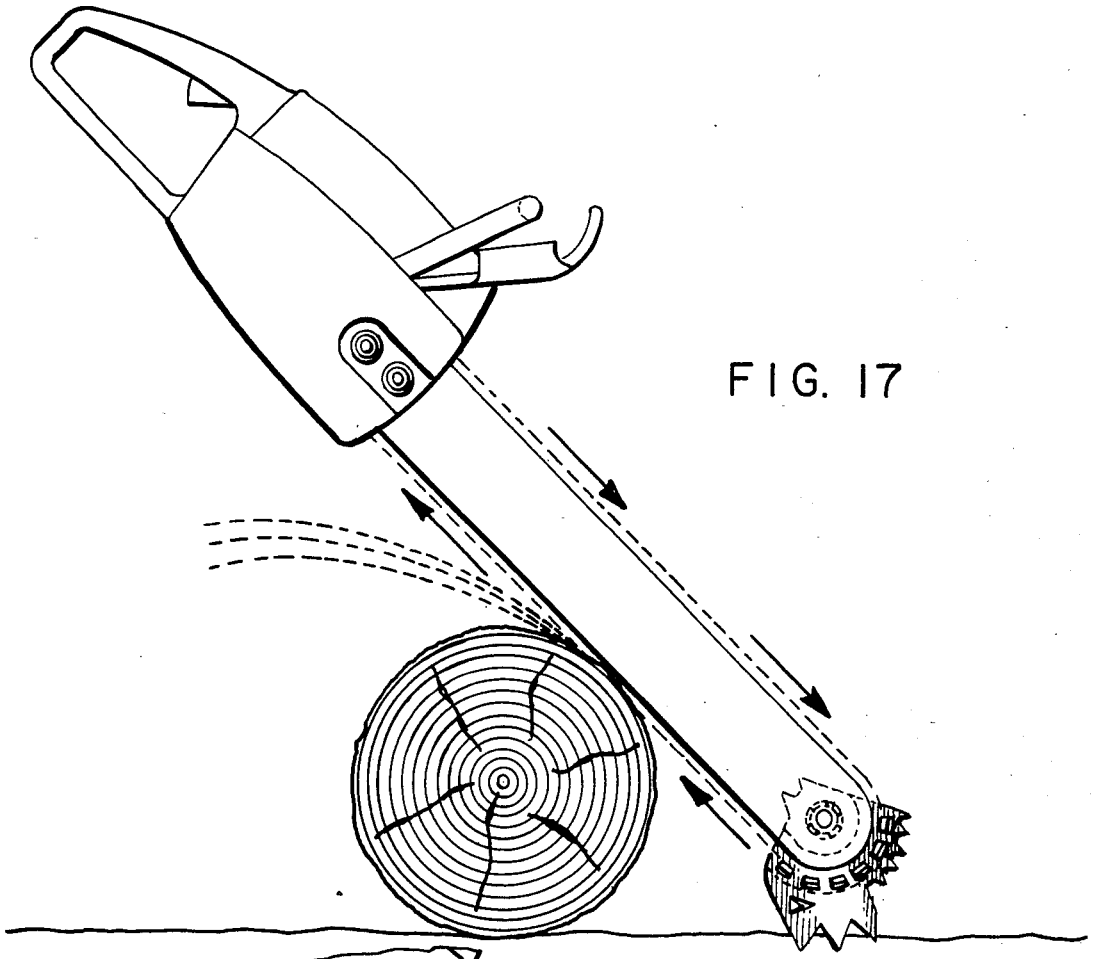
FIG. 17 is a side elevational view illustrating the tip stabilizing device of FIG. 1 attached to a chain saw having conventional chain movement and engaging the ground while making a bucking cut.
Figure 18:
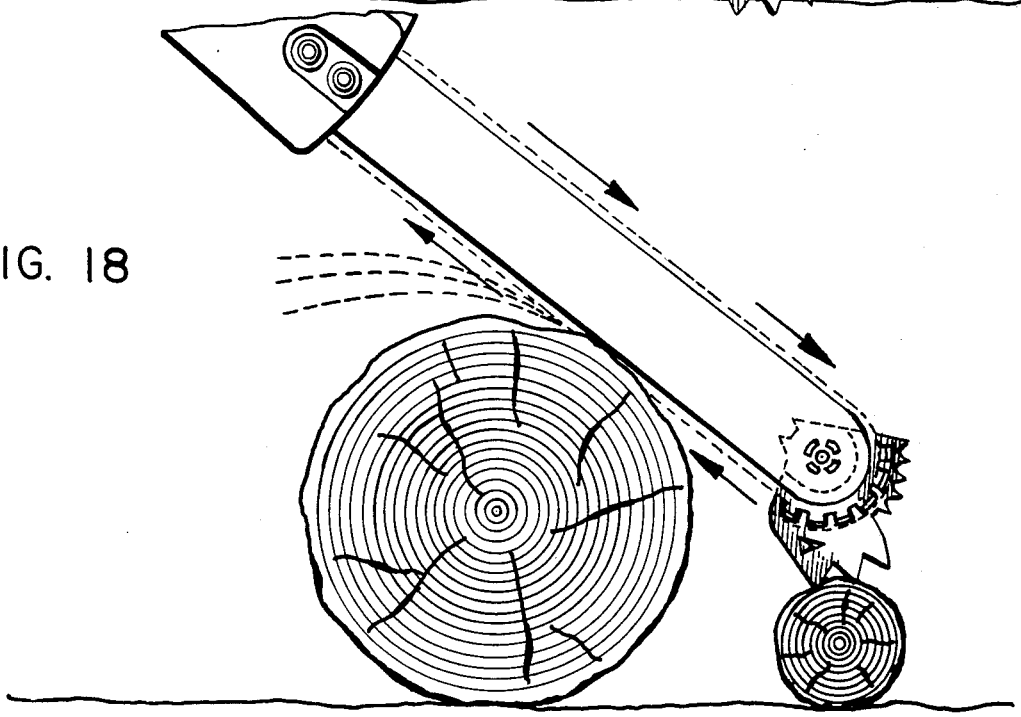
FIGS. 18 and 19 are side elevational views illustating the tip stabilizing device of FIG. 1 attached to a chain saw having conventional chain movement and engaging an adjacent log while making a bucking cut.
Figure 19:
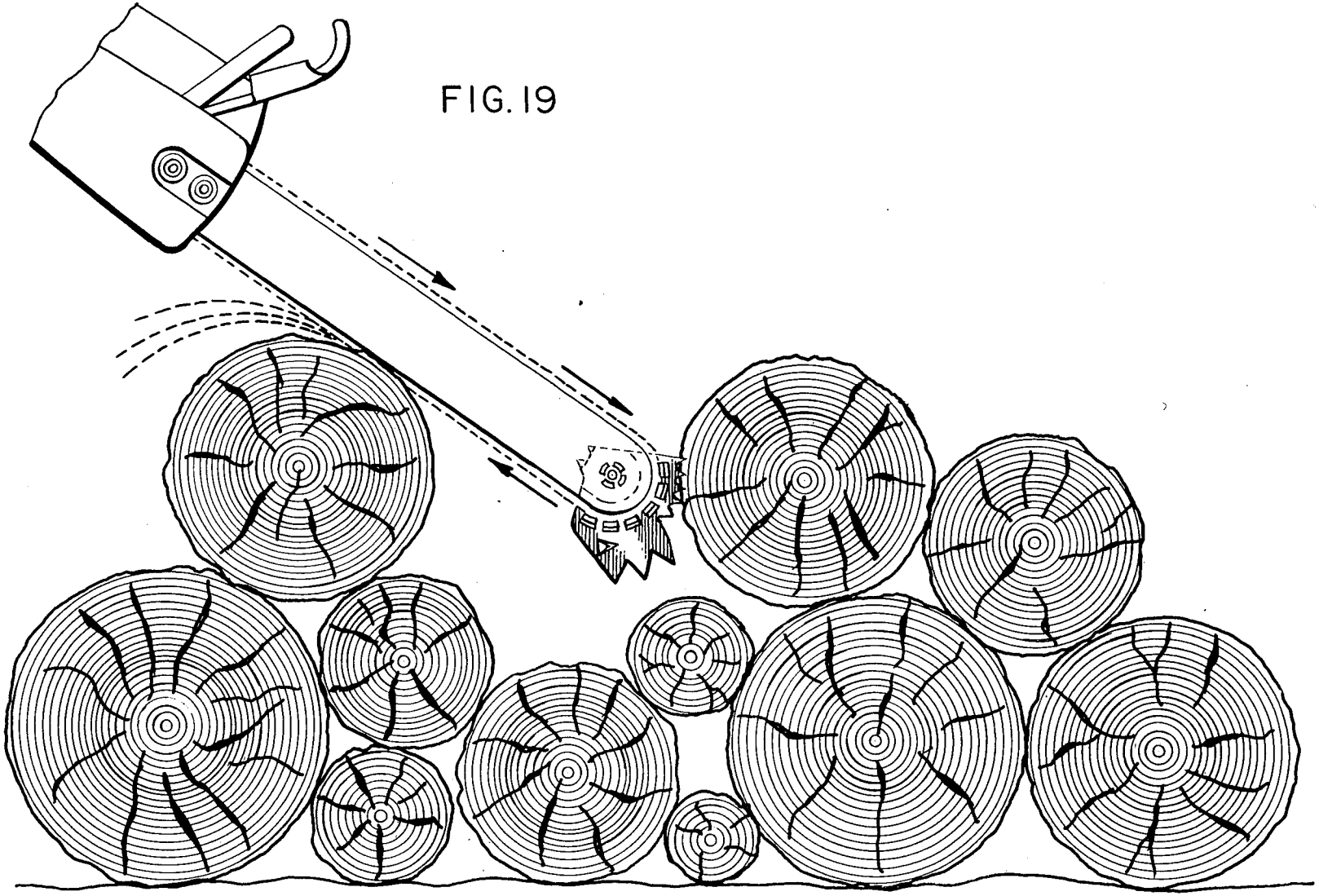

As shown in FIGS. 17–19, the tip stabilizer of this embodiment is attached to the forward end of the chain saw guide bar using mounting feature 119 and appropriate retaining means, e.g., a bolt or rivet. When attached, spikes 101, 102 and 201 extend forward of the guide bar and chain for engaging an adjacent surface. Elongated spikes 101 and 201 are especially suited for ground engagement, as shown in FIG. 17, when making a bucking cut using conventional chain movement as indicated by the direction of the arrows. In this application, normal forces generated at the chain/wood interface by the momentum of the chain pulls the saw forward causing spikes 101, 201 or 102 to self-engage into the ground. The saw may then be pivoted downwardly about the anchored point to complete the cutting operation. As the saw pivots downward, the above-described normal forces keep spikes 101, 201 or 102 in ground engagement, thus stabilizing the saw tip. Stabilizing the tip substantially increases the stability of the saw, thereby providing the operator with a much greater opportunity to maintain control over the saw.

Because the saw is resting on a stabilized tip and there is reduced handforces, the amount of vibration that is transmitted to the operator's hands and arms is reduced. It has been suggested that prolonged exposure to chain saw vibration, coupled with other factors, may have adverse effects over time, often leading to the development of Raynaud's Syndrome or "white fingers." Thus, in situations where chain saws are routinely and regularly used, a means for reducing vibration is particularly advantageous. Reduced vibration also aids in operator comfort, thereby reducing fatigue and allowing the operator to be productive for much longer periods of time.

FIG. 18 illustrates the application of the present embodiment using an adjacent log as the supporting means. The application shown in FIG. 19 is similar, however, shorter spikes 102 are used to engage the adjacent log.

Side spikes 116 and 202 are used for side engagement and are particularly useful when limbing a fallen tree as shown in FIG. 29. Either side spoke 116 or 202 self-engage the trunk of the tree, as the saw rests on a limb extending outward of the trunk of the tree, thus allowing pivoting action.

Figure 21:
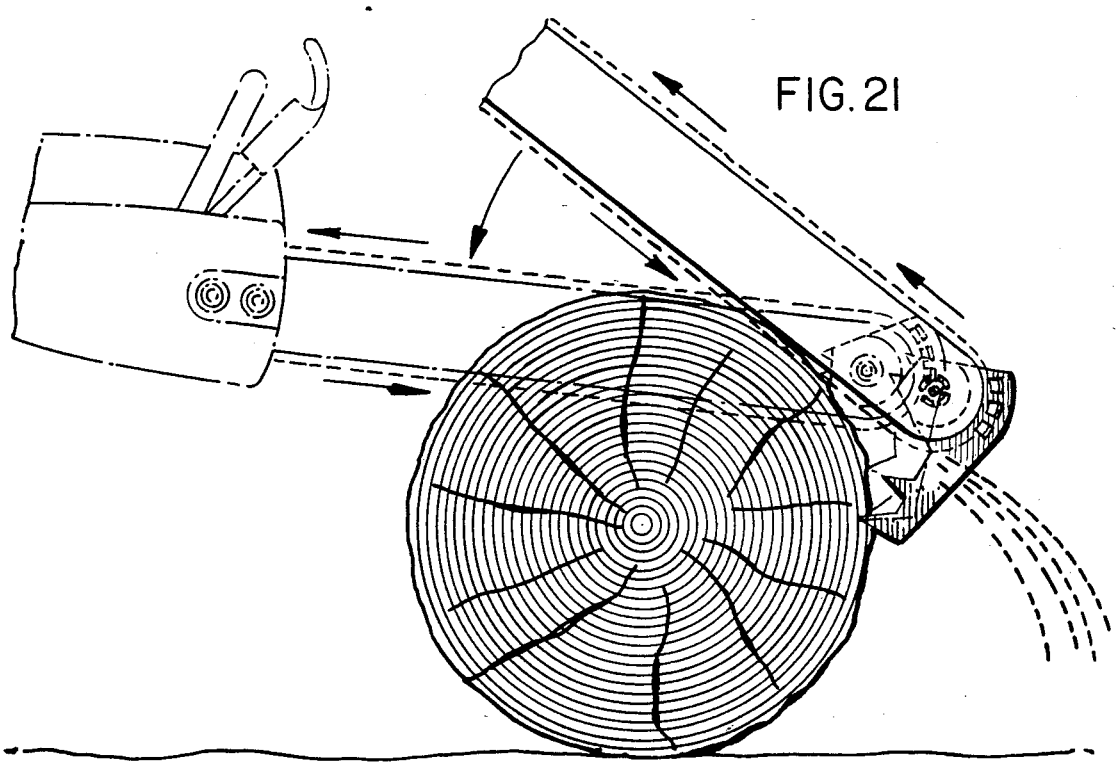
FIGS. 21 and 22 are side elevational views illustrating the tip stabilizing device of FIG. 11 attached to a chain saw having reverse chain movement and engaging the log being cut while making a bucking cut.
Figure 22:
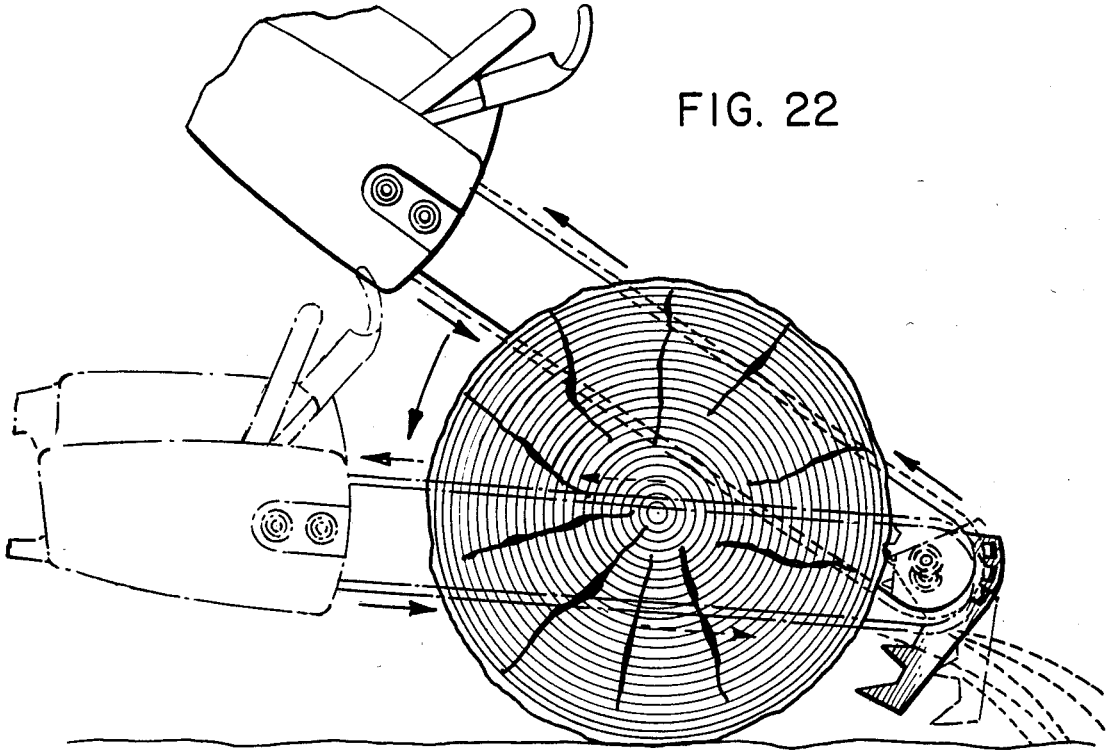

The operation of reverse spikes 117 can be understood with reference to FIGS. 21, 22 and 27. While these figures show different embodiments of the invention, they are illustrative of the operation of reverse spikes 117. FIGS. 21 and 22 show a chain saw making a bucking cut and having reverse chain direction as indicated by the arrows. In this application, the normal forces generated at the chain/wood interface by the momentum of the moving chain pushes the saw in the direction of the operator. Thus, with the tip stabilizer of the present embodiment (FIGS. 1–6) attached to the guide bar, reverse spikes 117 self-engage the log being cut adjacent the cutting groove as best shown in FIG. 22. FIG. 27 shows a chain saw making an undercut and having conventional chain direction as indicated by the arrows. In this application, normal forces at the chain/-wood interface also push the saw in the direction of the operator. Thus, reverse spikes 117 likewise self-engage the log, stabilizing the saw tip.

In the embodiment of the invention shown in FIGS. 7–10, the tip stabilizing device is of single-piece construction. One piece construction results in a device that is easier and less expensive to manufacture. This embodiment of the tip stabilizer includes plate 300 with mounting feature 301 and spiked flange 302. The stabilizer is attached to the forward end of the guide bar as described in further detail below.

Figure 9:
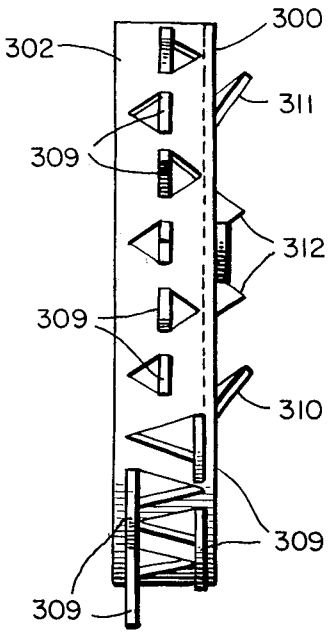
FIG. 9 is a front elevational view of the tip stabilizing device of FIG. 7 showing an alternate spike arrangement.
Figure 8:
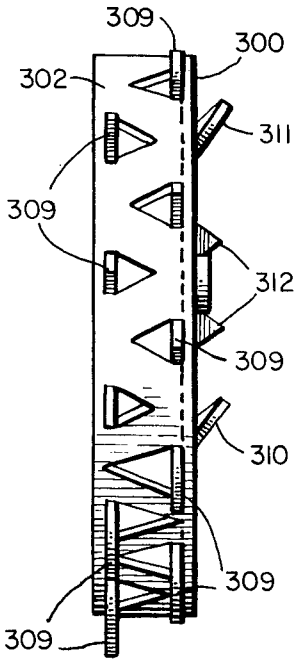
FIG. 8 is a front elevational view of the tip stabilizing device of FIG. 7.
Figure 7:
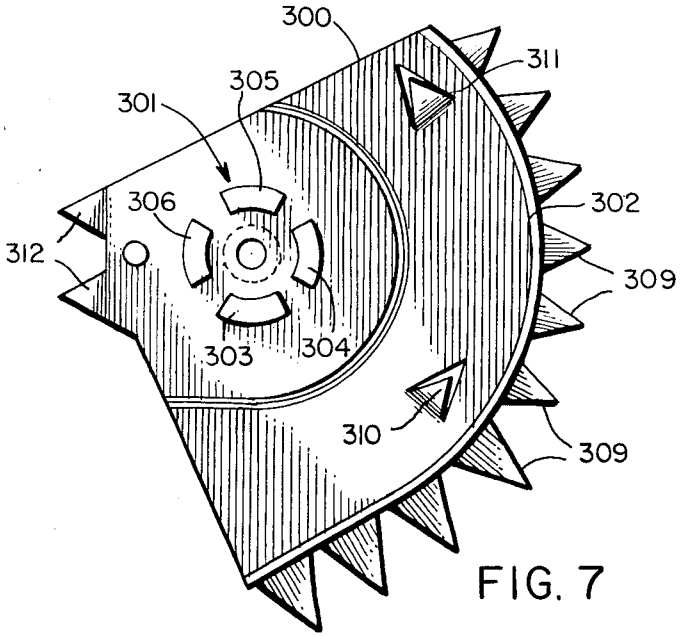
FIG. 7 is a side elevational view of the tip stabilizing device according to another embodiment of the invention.
Figure 10:
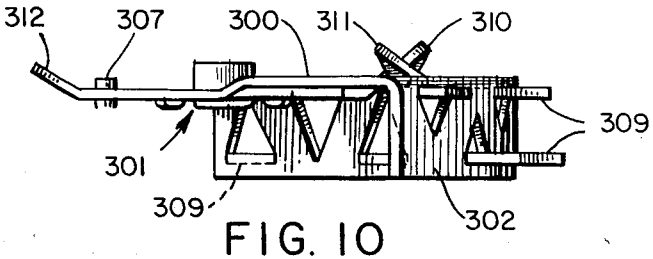
FIG. 10 is a top elevational view of the tip stabilizing device of FIG. 7.

With reference to FIG. 7, mounting feature 301 includes mounting hole 308, protrusions 303–306 and raised anti-rotation tab 307. These inter-related elements are similar in purpose and function to the corresponding elements associated with mounting feature 119 as discussed with respect to the above first embodiment of the present invention. Flange 302 includes a series of spikes 309. Spikes 309 may be blanked from flange 302 in a variety of patterns as shown in FIGS. 8 and 9. When the device is attached to the guide bar, spikes 309 extend forward of the guide bar and chain for engaging a log or other supporting surface to stabilize the saw tip. Flange 302 also serves as a chain guard to prevent the chain from whipping back toward the operator should it break. Flange 302 further serves as a protective shield to prevent soil or other abrasives from contacting the moving chain and causing damage to the chain and guide bar.

Base plate 300 also includes upwardly projecting side spikes 310 and 311 and reverse spikes 312. These spikes are similar in purpose and function to side spikes 116 and 202 and reverse spikes 117 as described with respect to the above first embodiment of the invention.

Figure 20:
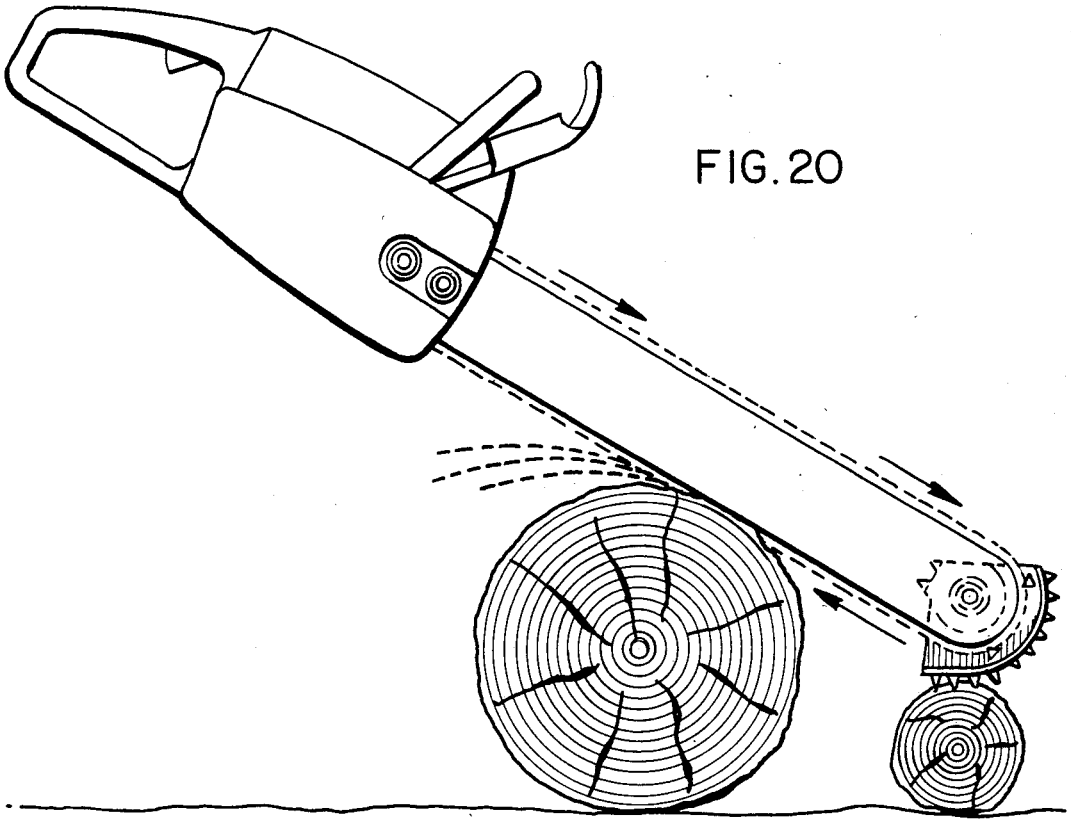
FIG. 20 is a side elevational view illustrating the tip stabilizing device of FIG. 7 attached to a chain saw having conventional chain movement and engaging an adjacent log while making a bucking cut.

The application of this embodiment of the invention is best illustrated by FIG. 20. FIG. 20 shows a chain saw making a bucking cut and having conventional chain movement as indicated by the direction of the arrows. The forces generated at the chain/wood interface by the momentum of the moving chain cause the tip stabilizer to self-engage the adjacent log. The saw tip is accordingly stabilized, substantially increasing the stability of the saw and making it much easier to control.

Figure 11:
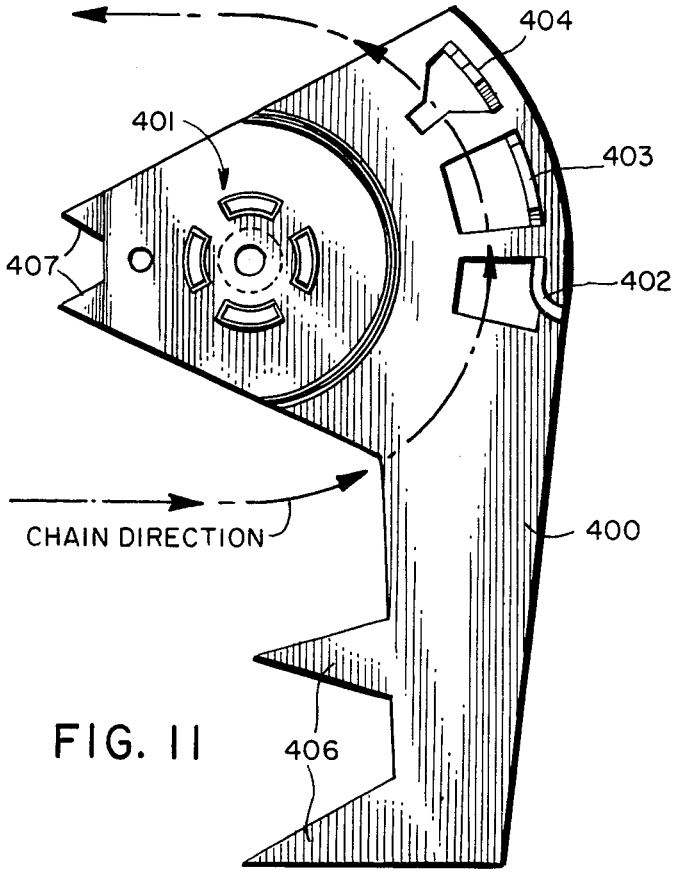
FIG. 11 is a side elevational view of the tip stabilizing device according to a further embodiment of the invention.
Figure 12:
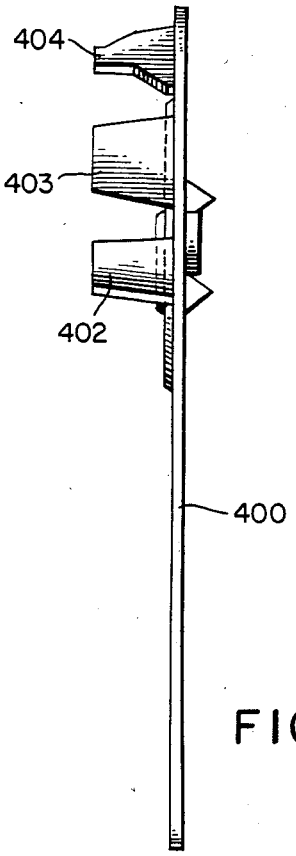
FIG. 12 is a front elevational view of the tip stabilizing device of FIG. 11.
Figure 13:
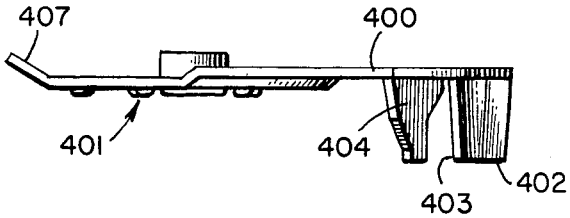
FIG. 13 is a top elevational view of the tip stabilizing device of FIG. 11.

In the embodiment of the invention shown in FIGS. 11–13, the tip stabilizing device may also be of single-piece construction. This embodiment is primarily designed for chain saws having reverse chain movement. With reference to FIG. 11, base plate 400 includes mounting feature 401, reverse spikes 407, upwardly projecting tabs 402–404 and spikes 406.

Mounting feature 401 includes the same inter-related elements and serve a similar purpose and function as mounting feature 119 as described in the above first embodiment of the invention.

Tabs 402–404 may be blanked from base plate 400. Tabs 402–405 serve as a chain guard as well as a protective shield to prevent soil or abrasives from coming into contact with the moving chain. Tab 402 also serves as a chute or baffle for feeding sawdust away from the operator. The outline of tab 404 is specially formed to provide a chain gauge as discussed with respect to the above first embodiment of the invention and shown in detail in FIG. 14.

FIGS. 21 and 22 illustrate the application of the present embodiment of the invention. A chain saw is shown making a bucking cut and having reverse chain movement as indicated by the direction of the arrows. When starting a cut in the log, as shown in FIG. 21, spikes 406 self-engage the log due to the action of the forces at the chain/wood interface pushing the saw toward the operator. Once the saw has cut into the log, as shown in FIG. 22, reverse spikes 407 self-engage. Thus, spikes 406 and 407 permit the saw tip to be stabilized for the duration of the cut.

This embodiment of the invention may also be effectively used on a saw having conventional chain movement in undercutting situations and in felling operations.

Figure 15:
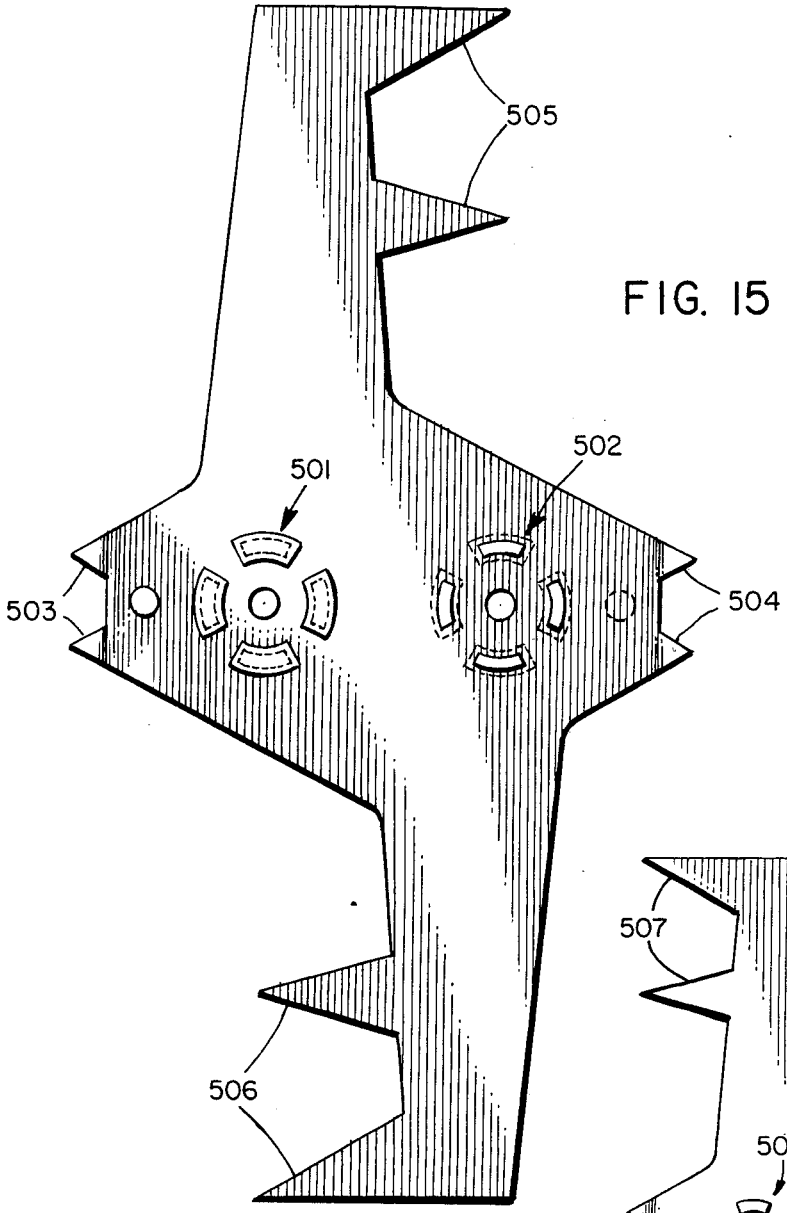
FIG. 15 is a side elevational view of a tip stabilizing device according to another embodiment of the invention.

In the embodiment of the present invention shown in FIG. 15, the stabilizing tip is of single-piece construction and is designed for use with a chain saw having either conventional or reverse movement of the chain. It is comprised of symmetrical mounting features 501 and 502, symmetrical middle spikes 503 and 504 and symmetrical end spikes 505 and 506.

Mounting features 501 and 502 and their related elements are similar in purpose and function to mounting feature 119 in FIG. 5 as described with respect to the above first embodiment of the invention. Depending upon the application, the operator can select which mounting feature to use. The operation of end spikes 505 and 506 and middle spikes 503 and 504 can best be understood with reference to FIGS. 23–28.

Figure 23:
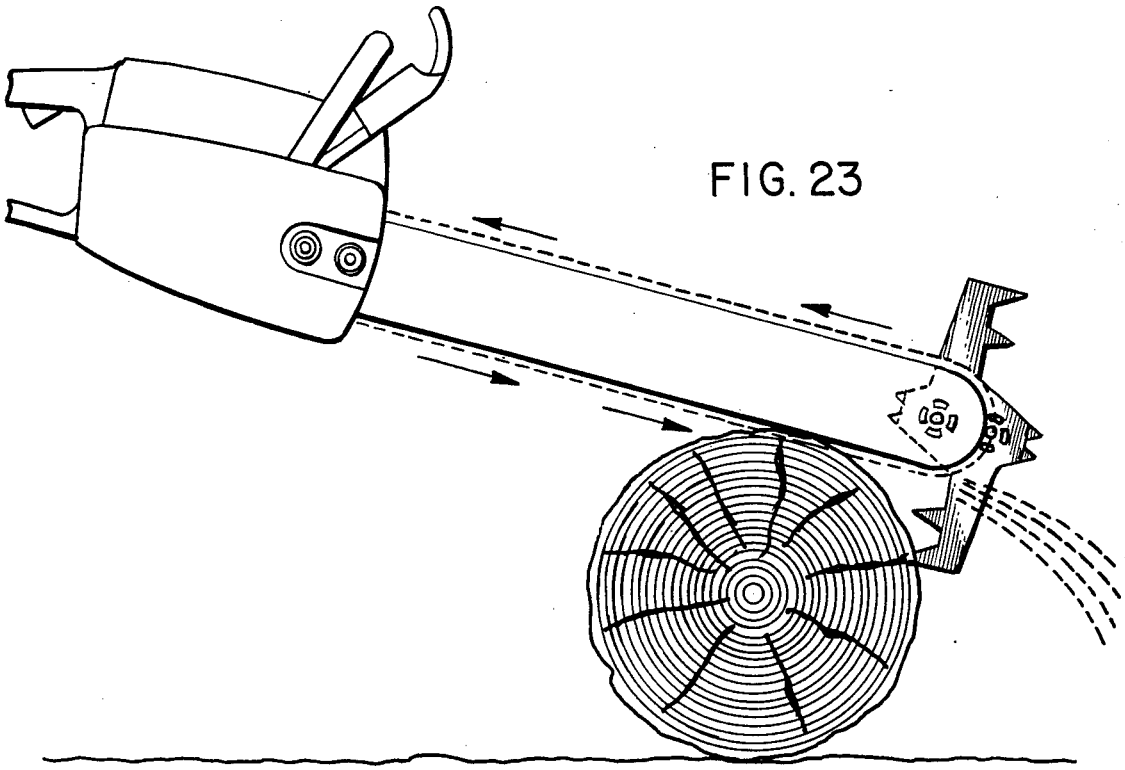
FIGS. 23 and 24 are side elevational views illustrating the tip stabilizing device of FIG. 15 attached to a chain saw having reverse chain movement and engaging the log being cut while making a bucking cut.
Figure 24:
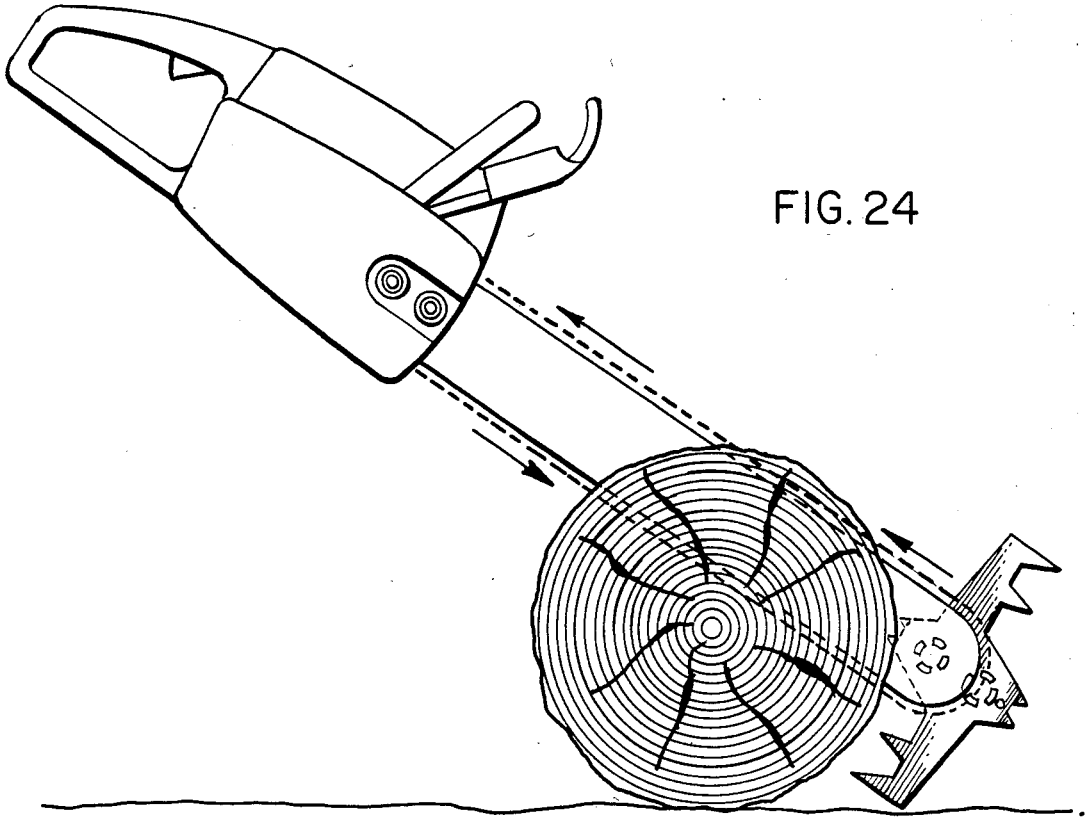

FIG. 23 and 24 illustrate a chain saw making an bucking cut and having reverse chain movement as indicated by the direction of the arrows. When the saw first cuts into the log, as shown in FIG. 23, spikes 506 self-engage the log as a result of the normal forces generated at the chain/wood interface pushing the saw in the direction of the operator. As the saw cuts through the log, as shown in FIG. 24, spikes 503 also self-engage, further stabilizing the saw tip.

Figure 25:
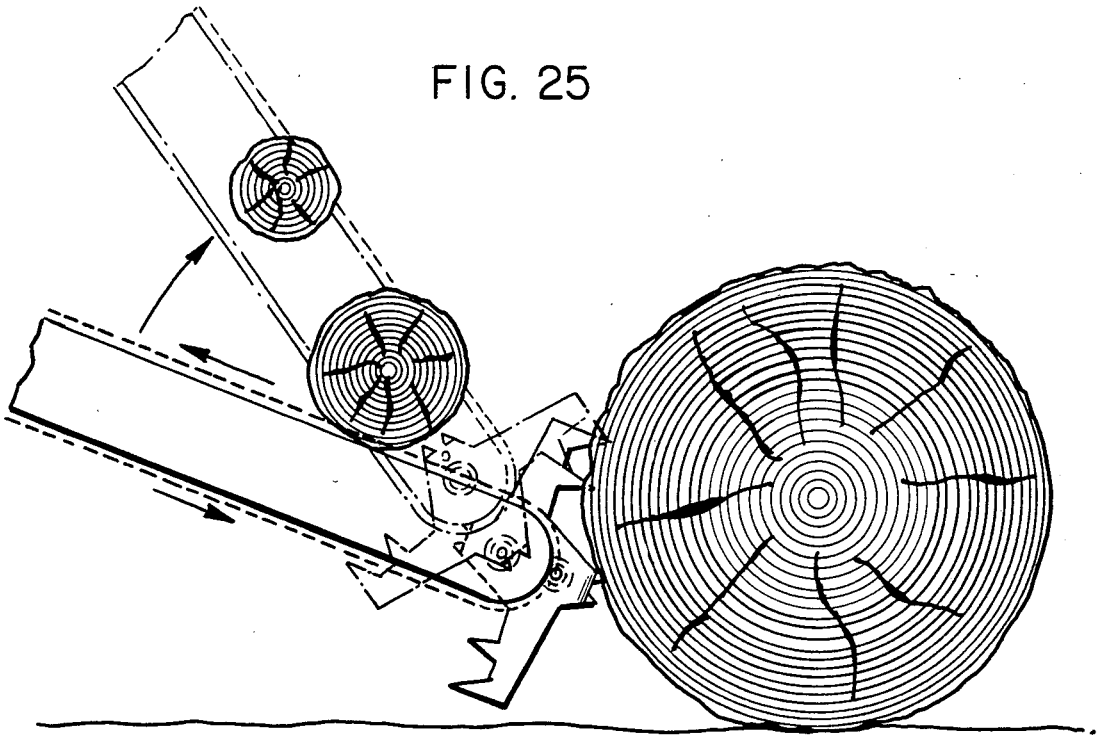
FIG. 25 is a side elevational view illustrating the tip stabilizing device of FIG. 15 attached to a chain saw having reverse chain movement and engaging an adjacent log while making an undercut.

With reference to FIG. 25, reverse chain movement is used to make an undercut. In this application, the normal forces at the chain/wood interface causes spikes 505 to self-engage an adjacent log. Thus, stabilizing the saw tip.

In the applications shown in FIGS. 23, 24 and 25, mounting feature 501 is used to attach the stabilizer tip to the guide bar.

FIGS. 26–28 illustrate application of this embodiment of the tip stabilizer with a saw having normal conventional chain direction. In these applications, mounting feature 502 is used to attach the stabilizer to the guide bar. In FIG. 26, the force at the chain/wood interface causes spike 506 to self-engage the ground; in FIG. 27, spikes 504 and 505 are caused to self-engage the log being cut and in FIG. 28, middle spike 503 is caused to self-engage an adjacent log.

Figure 16:
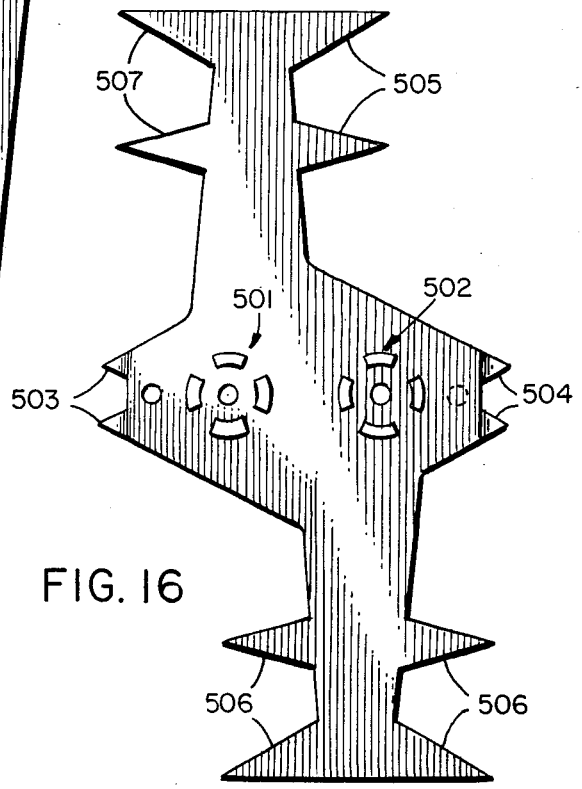
FIG. 16 is a side elevational view of the tip stabilizing device according to a further embodiment of the invention.

FIG. 16 illustrates a similar embodiment to that of FIG. 15 but includes additional spikes 507 and 508. The addition of spikes 507 and 508 permit the device to be used in any variety of cutting operations without remounting, thus using the alternate mounting geature.

The above embodiment of the invention, therefore, enables the saw tip to be stabilized in a variety of cutting situations.

The above several embodiments of the present invention describe a tip stabilizing device for attachment to a portable power chain saw which makes the saw safer and easier to operate while overcoming many of the disadvantages of chain saw attachments known in the prior art. Obviously, many modifications and variations of the above-described preferred embodiments will become apparent to those skilled in the art from a reading of this disclosure. It should be realized that the invention is not limited to the particular apparatus disclosed, but its scope is intended to be governed only by the scope of the appended claims.

I claim:

1. In a portable power chain saw of the straight guide bar type having a guide bar with substantially straight sides and a chain traveling around the guide bar to cut wood or other material on said substantially straight sides of said guide bar, a tip device for attachment to the guide bar for improving the operation and safety of said chain saw, said tip device comprising:

a substantially flat plate rigidly attached to the forward end of the guide bar; and tip stabilizing means connected to said plate and responsive to the forces produced between said chain and the wood or other material being cut for engaging a fixed surface other than the wood or other material being cut and which is located at the forward end of said guide bar to stabilize the operation of said chain saw, said tip stabilizing means having at least one spike extending outwardly past the rounded end of the guide bar to engage the fixed surface in response to the forces between said chain and the wood or other material being cut during operation of said chain saw.

2. The tip device of claim 1 wherein said plate is positioned on the guide bar to prevent said tip device from interfering with the removal and replacement of said chain around the guide bar.

3. The tip device of claim 1 wherein said spike is a forward spike which extends toward the forward end of the guide bar to engage the fixed surface when said chain is traveling in a clockwise direction and said chain saw is being used to make an overcut.

4. The tip device of claim 3 wherein said tip stabilizing means comprises a plurality of forward spikes which extend toward the forward end of the guide bar in upward and downward directions with respect to the forward end of the guide bar.

5. The tip device of claim 4 wherein said plurality of spikes are positioned in at least two rows and are of different lengths.

6. The tip device of claim 3 wherein the fixed surface is the ground.

7. The tip device of claim 3 wherein the fixed surface is an adjacent log or other supporting surface.

8. The tip device of claim 1 wherein said spike is a forward spike which extends toward the forward end of the guide bar to engage the fixed surface when said chain is traveling in a counterclockwise direction and said chain saw is being used to make an undercut.

9. The tip device of claim 1 wherein said spike is a forward spike which extends toward the forward end of the guide bar to engage the fixed surface when said chain is traveling in a counterclockwise direction and said chain saw is being used to make an overcut.

10. The tip device of claim 1 wherein said plate further comprises anti-rotation means for preventing rotation of said tip device when attached to the guide bar.

11. The tip device of claim 10 wherein said anti-rotation means comprises a plurality of raised tabs in engagement with the guide bar.

12. The tip device of claim 1 wherein said plate further comprises a plurality of tabs raised perpendicular to said plate for preventing dirt, abrasions and foreign objects from causing damage to said chain and the guide bar at the nose of the chain saw.

13. The tip device of claim 12 wherein said plurality of tabs are located to surround the chain at the forward end of the guide bar for preventing the chain from whipping back toward the operator should the chain break when traveling along the guide bar.

14. The tip device of claim 1 wherein said plate is attached to the forward end of the guide bar in a position to prevent the conditions for kickback of the chain saw from occurring by preventing the upper quadrant of the forward end of the guide bar from being used as a cutting surface.

15. In a portable power chain saw of the straight guide bar type having a guide bar with substantially straight sides and a chain traveling around the guide bar to cut wood or other material on said substantially straight sides of said guide bar, a tip device for attachment to the guide bar for improving the operation and safety of said chain saw, said tip device comprising:

a substantially flat plate rigidly attached to the forward end of the guide bar; and tip stabilizing means connected to said plate and responsive to the forces produced between said chain and the wood or other material being cut for engaging a fixed surface other than the wood or other material being cut and which is located at the forward end of said guide bar to stabilize the operation of said chain saw, said tip stabilizing means having at least one first spike extending outwardly past the rounded end of the guide bar to engage the fixed surface in response to the forces between said chain and the wood or other material being cut during operation of said chain saw, said tip stabilizing means further comprises a second spike which extends toward the rear end of the guide bar to engage the fixed surface when said chain is traveling in a clockwise direction and said chain saw is being used to make an undercut.

16. The tip device of claim 15 wherein said tip stabilizing means further comprises a lateral spike which extends laterally from the guide bar to engage the fixed surface.

17. The tip device of claim 16 wherein said lateral spike extends laterally and forwardly to engage the fixed surface when said chain is traveling in a clockwise direction and said chain saw is pivoted in a counterclockwise direction as the chain saw makes an undercut.

18. The tip device of claim 17 wherein the fixed surface is a tree and the wood being cut is a limb of the tree, said lateral spike engaging the surface of the tree when said chain saw is being used to perform a limbing operation.

19. The tip device of claim 16 wherein said forward spike, said rearward spike and said lateral spike are of different lengths.

20. The tip device of claim 19 wherein said lateral spike and said rearward spike are selectively mountable by the chain saw user.

21. The tip device of claim 16 wherein said device is of one-piece construction.

22. The tip device of claim 16 wherein said tip stabilizing means comprises a lateral spike extending from each side of the guide bar.

23. The tip device of claim 15 wherein the fixed surface is the surface of the wood or other material being cut.

24. The tip device of claim 15 wherein said tip stabilizing means comprises a plurality of rearward spikes which extend toward the rear of the guide bar in upward and downward directions with respect to the forward end of the guide bar.

25. The tip device of claim 16 wherein said lateral spike extends laterally and forwardly to engage the fixed surface when said chain is traveling in a counterclockwise direction and said chain saw is rotated in a clockwise direction while being used to make an undercut.

26. A portable power chain saw having a stabilized tip, said chain saw comprising:

a power head;

a guide bar with substantially straight sides attached to said power head;

a chain traveling around said guide bar to cut wood or other material on said substantially straight sides of said guide bar; and a tip device attached to said guide bar for improving the operation and safety of said chain saw, said tip device including a substantially flat plate rigidly attached to the forward end of said guide bar; and tip stabilizing means connected to said plate and responsive to the forces produced between said chain and the wood or other material being cut for engaging a fixed surface other than the wood or other material being cut and which is located at the forward end of said guide bar to stabilize the operation of said chain saw, said tip stabilizing means having at least one spike extending outwardly past the rounded end of the guide bar to engage the fixed surface in response to the forces between said chain and the wood or other material being cut during operation of said chain saw.

* * * * *